United States Patent [19]

Glanvall

[11] Patent Number: 4,932,844

[45] Date of Patent: Jun. 12, 1990

[54] CONTROL SECTION FOR A CONTROL SYSTEM FOR CONTROLLING THE INTERNAL VOLUME OF A ROTARY COMPRESSOR

[75] Inventor: Rune V. Glanvall, Norrköping, Sweden

[73] Assignee: Stal Refrigeration AB, Sweden

[21] Appl. No.: 255,026

[22] Filed: Oct. 7, 1988

[30] Foreign Application Priority Data

Oct. 28, 1987 [SE] Sweden ..... 8704196

[51] Int. Cl.[5] ..... F04B 49/02; F16K 31/12

[52] U.S. Cl. ..... 417/309; 417/310; 417/440; 251/28; 251/31

[58] Field of Search ..... 417/309, 310, 440; 418/201 A; 137/625.66, 625.69; 251/26, 28, 31, 63

[56] References Cited

U.S. PATENT DOCUMENTS 3,578,025 5/1971 Furrer ..... 137/625.66
3,936,239 2/1976 Shaw ..... 418/201
4,080,110 3/1978 Szymaszek ..... 417/310

*Primary Examiner*—Leonard E. Smith
*Assistant Examiner*—John A. Savio, III
*Attorney, Agent, or Firm*—Watson, Cole, Grindle & Watson

[57] ABSTRACT

For controlling the internal volume of a rotary compressor (5), adjustable valve bodies (3) are used on the outlet side. External control means, often of an extremely complicated nature, have previously been used to control the internal volume in the rotary compressor. By allowing the different pressure levels of the rotary compressor (5) to directly influence a control section (1), the position of the valve body (3) can be controlled by an operating section (2). In the control section (1) an intermediate pressure (9) from the compressor is balanced against a pressure from the high-pressure side (19) of the compressor by a plunger (6) having different diameters. The position of the plunger (6) then determines the control of the internal volume by the position of the valve body (3) connected to the operating section (2).

4 Claims, 4 Drawing Sheets

1) $K = \frac{Pm}{P2}$

CONTROL SECTION FOR A CONTROL SYSTEM FOR CONTROLLING THE INTERNAL VOLUME OF A ROTARY COMPRESSOR

TECHNICAL FIELD

The present invention relates to a control section for a control system for controlling the internal ratio by volume of a rotary compressor with respect to the load requirement in order to achieve optimum efficiency. The internal volume of a rotary compressor of a cooling or heating pump system is controlled by means of one or more displaceable valve bodies, to allow adjustment to the pressure ratio of the compressor.

BACKGROUND ART

The built-in or so-called internal volume of a rotary compressor should maintain a specific relation to the pressure ratio of the compressor if optimum efficiency is to be obtained. It must therefore be possible to vary the internal volume depending on whether full load or partial load prevails. The internal volume can be controlled, for instance, by an axially adjustable slide. Stepwise control of the internal volume can be performed, for instance, using several radially adjustable lift valves. Stepless control of the internal volume, however, usually requires an extremely complicated control system. Such a system for control of the internal volume may comprise a hydraulic system with solenoid valves and some form of calculating unit, for instance a processor, which controls the solenoid valves depending on the prevailing pressure ratio. The solenoid valves in the hydraulic system are then opened or closed to allow different pressure levels access to a hydraulic motor connected to an adjustable slide, for instance, to position this and thus control the internal volume.

DISCLOSURE OF THE INVENTION

To enable control of the internal volume in a rotary compressor without the use of external control means, a control system has been arranged which, depending on the various pressure levels of the compressor, controls the position of one or more valve bodies on the outlet side.

By designing a pressure sensing plunger 6 in a control section with at least two cylindrical end parts 15, 15' having different diameters $D_1$, $D_2$, the control section is able to operate completely within a desirable changeover region "A", see FIGS. 2 and 3. Only pressure differences and reference pressures influence the pressure sensing plunger in the control section for adjustment of the built-in volume to the prevailing operating case. To be able to return the plunger 6 in case of compressor stop, the control section is provided with a spring 20, arranged to operate at one end of the plunger 6.

DESCRIPTION OF THE PREFERRED EMBODIMENT

Figure 1:
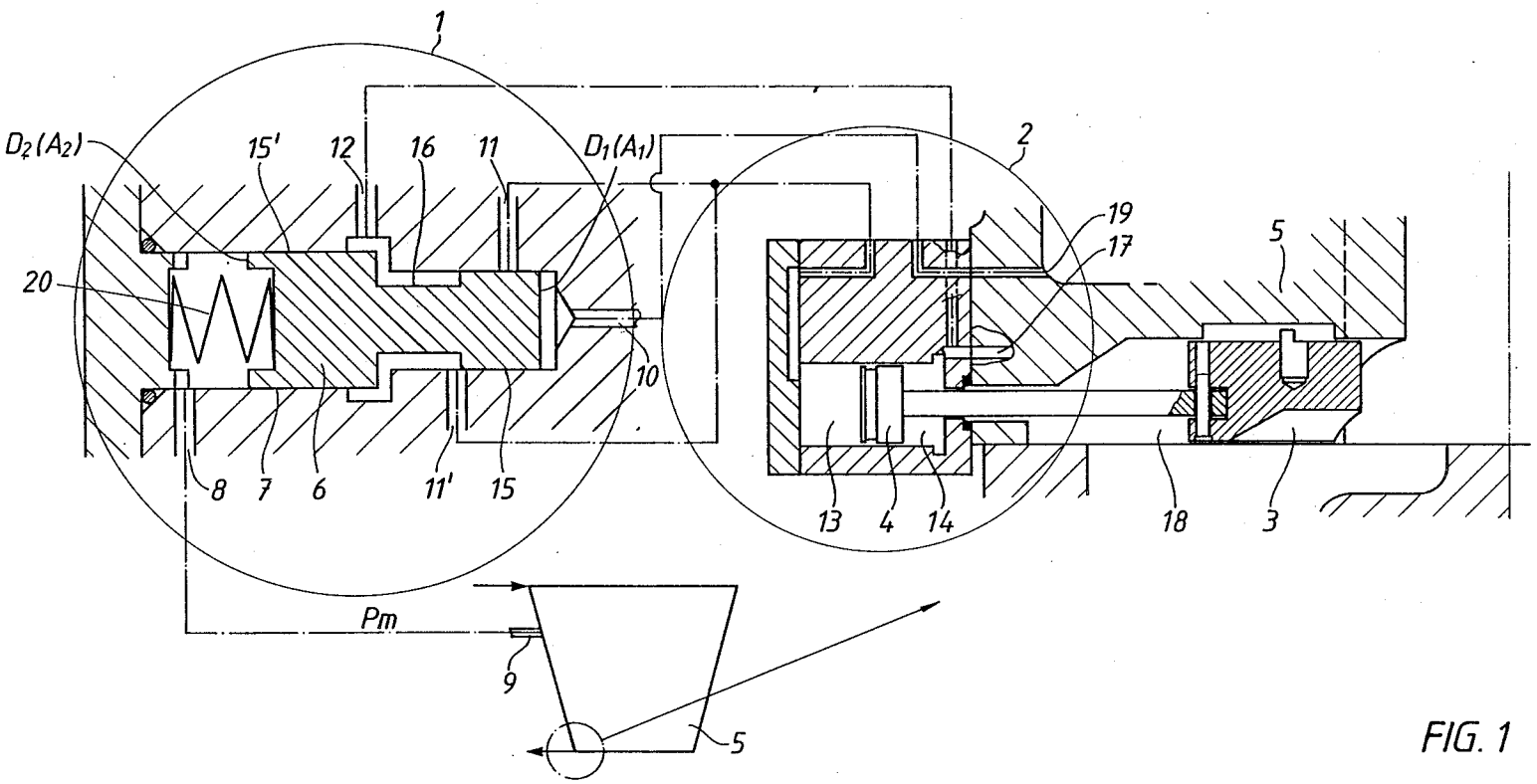
FIG. 1 shows a system for controlling the internal volume of a rotary compressor.

The control system for controlling the internal volume of a rotary compressor according to the invention substantially comprises a control section 1 and an operating section 2 connected body 3 for controlling the internal volume in the rotary compressor 5. The control section 1 comprises a cylindrical space 7 having different internal diameters and having a movable plunger 6 with different external diameters, this plunger 6 being axially adapted to the internal diameters of the space 7 and being influenced by fluid pressure and spring force. When the plunger 6 moves in the cylindrical space 7, one end of the envelope surface 15 of the plunger 6, with a diameter $D_1$, will expose or close openings 11, 11' in the wall of the cylindrical space 7. The other end of the plunger 6 with a larger diameter $D_2$ is mainly influenced by a fluid pressure, corresponding to an intermediate pressure deriving from the operating chamber 9 of the rotary compressor 5. The fluid pressure mentioned is supplied through an opening in the wall of the cylindrical space 7, at one of the end surfaces thereof. At the other end surface of the plunger 6 with the diameter $D_1$, a fluid pressure is exerted deriving from the high-pressure side 19 of the rotary compressor 5, where the fluid pressure is supplied to the cylindrical space 7 through an opening 10 in the end surface of the cylindrical space 7. The plunger 6 is shaped with a central portion 16 having a smaller diameter than the corresponding diameters of the surrounding end parts 15, 15'. An opening is arranged centrally in the wall of the cylindrical space 7, to allow access of fluid from the low-pressure side 17 of the rotary compressor 5 to the space between the wall of the cylindrical space 7 and the central tapering mid-section 16 of the plunger 6. The openings 11, 11' in the wall of the cylindrical space 7 are spaced apart and located between the central opening 12 and the end surface with the opening 10. The distance between the openings 11 and 11' and the length of the end 15 of the plunger 6 is chosen so that the plunger 6 can only simultaneously expose one of the openings 11 and 11' and close the other. The openings 11 and 11' may possibly comprise one single connection, but the arrangement of two axially displaceable openings offers a longer sealing surface 15 on the plunger 6. The openings 11, 11' are connected to the plunger-cylinder arrangement of the operating section 2. The operating section 2 consists of a plunger-cylinder arrangement, in which the piston-rod of the plunger 4 is connected to the valve body 3 to control the internal volume in the rotary compressor 5. The cylindrical space 7 on the piston-rod side 14 is connected to the low-pressure side 17 of the rotary compressor 5. The cylindrical space 14 is connected at its opposite end 13 to one of the two openings 11, 11' in the above-mentioned cylindrical space 7. The valve body 3 may be formed with a substantially triangular cross section with an end surface abutting the rotors of the rotary compressor 5 with minimum clearance when fully inserted. The valve body 3 may also be designed as part of the plunger 4. With such an arrangement, the control can be effected using several valve bodies.

A rotary compressor operates optimally when the pressure and volume are at a certain ration to each other: $P1/P2 = V_i^n$. Under varying operating conditions it is important that the internal volume $V_i$ can be adjusted to the prevailing operating conditions. This can be achieved in a stepless or a stepwise manner, stepwise control being considerably simpler to achieve than stepless control. However, stepwise control may often give such a good adaptation that the continuous, stepless control function cannot normally be considered justified when taking into account the output and the complicated construction.

Figure 2:
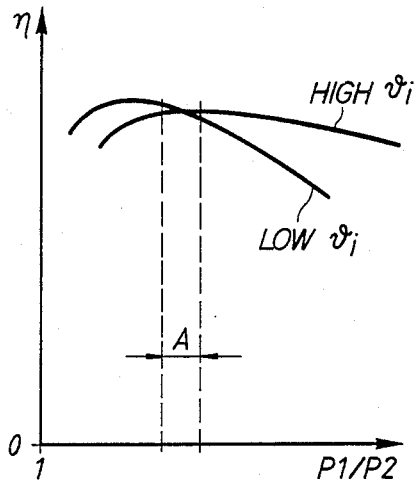
FIGS. 2 and 3 show a desirable changeover region as well as the the characteristics of the control section.
Figure 3:
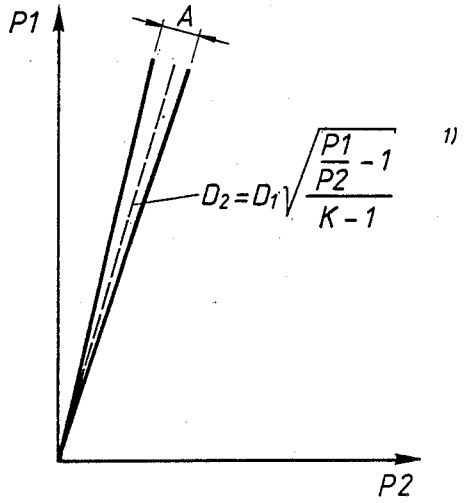

For stepwise control the pressure at which changeover shall occur between the various internal volumes must be determined. FIG. 2 shows in principle the total efficiency curves for a screw compressor with various internal volumes ($V_i$). The changeover should occur within a region "A" in order to achieve the highest efficiency, since the differences in efficiency for operating conditions within this region are small between different internal volumes. FIG. 3 shows in principle the corresponding changeover region in a P1/P2 diagram. A suitable choice of intermediate pressure 9 ($Pm = f(P(2))$) will give a changeover boundary corresponding well to the region "A". To further optimize the process, the inclination within the relevant operating limits can be changed by changing Pm, but this is considerably more difficult in practice. With the above-mentioned control section 1 according to the invention, a control can be achieved which is entirely within the desired region "A" in FIGS. 2 and 3. The pressure sensing plunger 6 with its two cylindrical ends 15, 15' having different diameters $D_1$, $D_2$ can be influenced by pressure differences and reference pressures. The single task of the spring 20 is here to return the plunger 6, when the compressor is stopped, to the desired end position for relieving the compressor before the next start-up. The spring force is therefore to be considered negligible in relation to the pressures, and thus the forces generated, which act on the end surfaces of the plunger 6. From the formula $$D2 = D1\sqrt{\frac{\frac{P1}{P2} - 1}{K - 1}}$$

it is seen that the diameter ratio is determined completely by the pressure ratio (P1/P2) at which the changeover is to take place and by which intermediate pressure factor K ($Pm = K \cdot P2$) is chosen. Thus, the diameter ratio is independent of the type of operation.

The cross section of the plunger 6 can, of course, deviate from the cylindrical, and from a mathematical point of view the respective end areas (A1, A2) must then be adapted to the corresponding area ratio $$\left(A2 = A1 \cdot \frac{P1/P2 - 1}{K - 1}\right).$$

Figure 4:
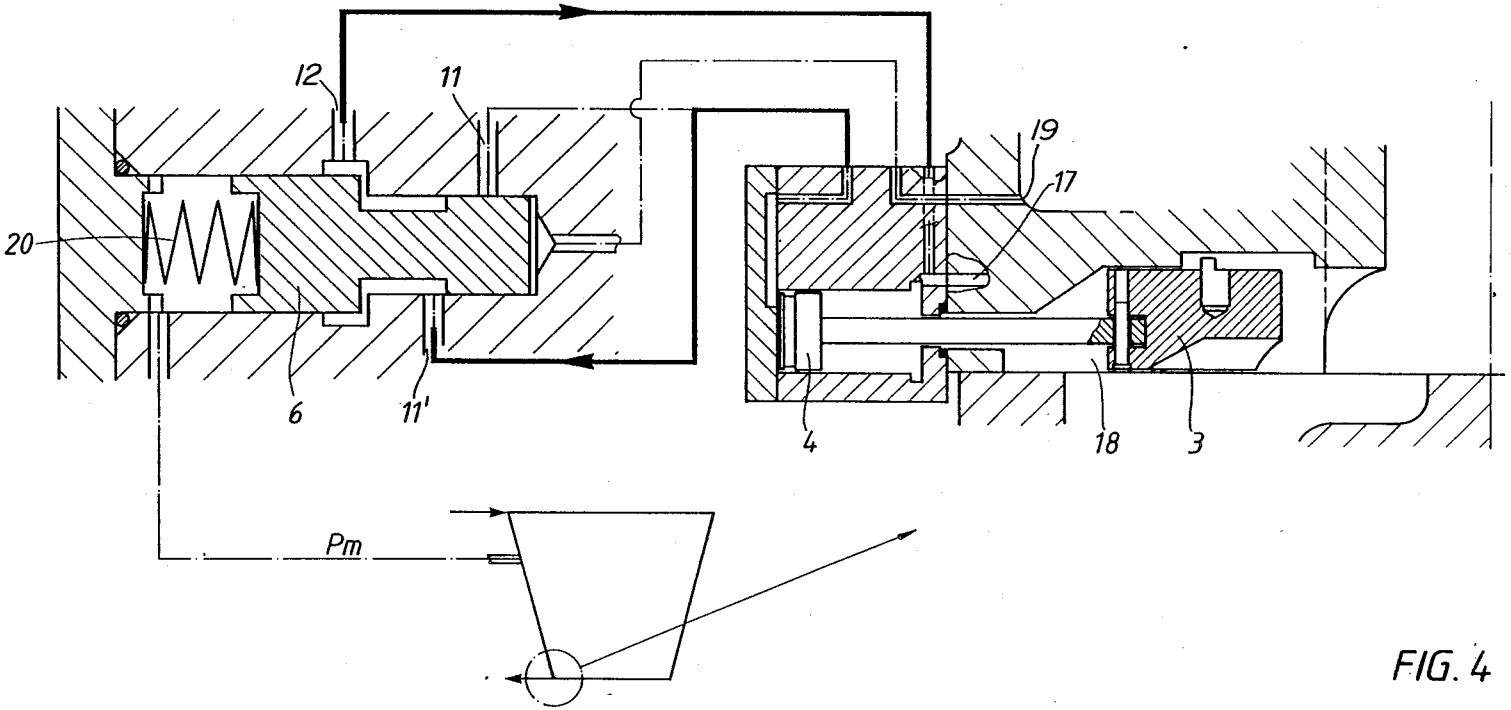
FIG. 4 shows the position of the control section for an operating case with a low pressure ratio (P1/P2) (to the right of the dashed line in FIG. 3) or partial load (reduced Pm) or before start-up.
Figure 5:
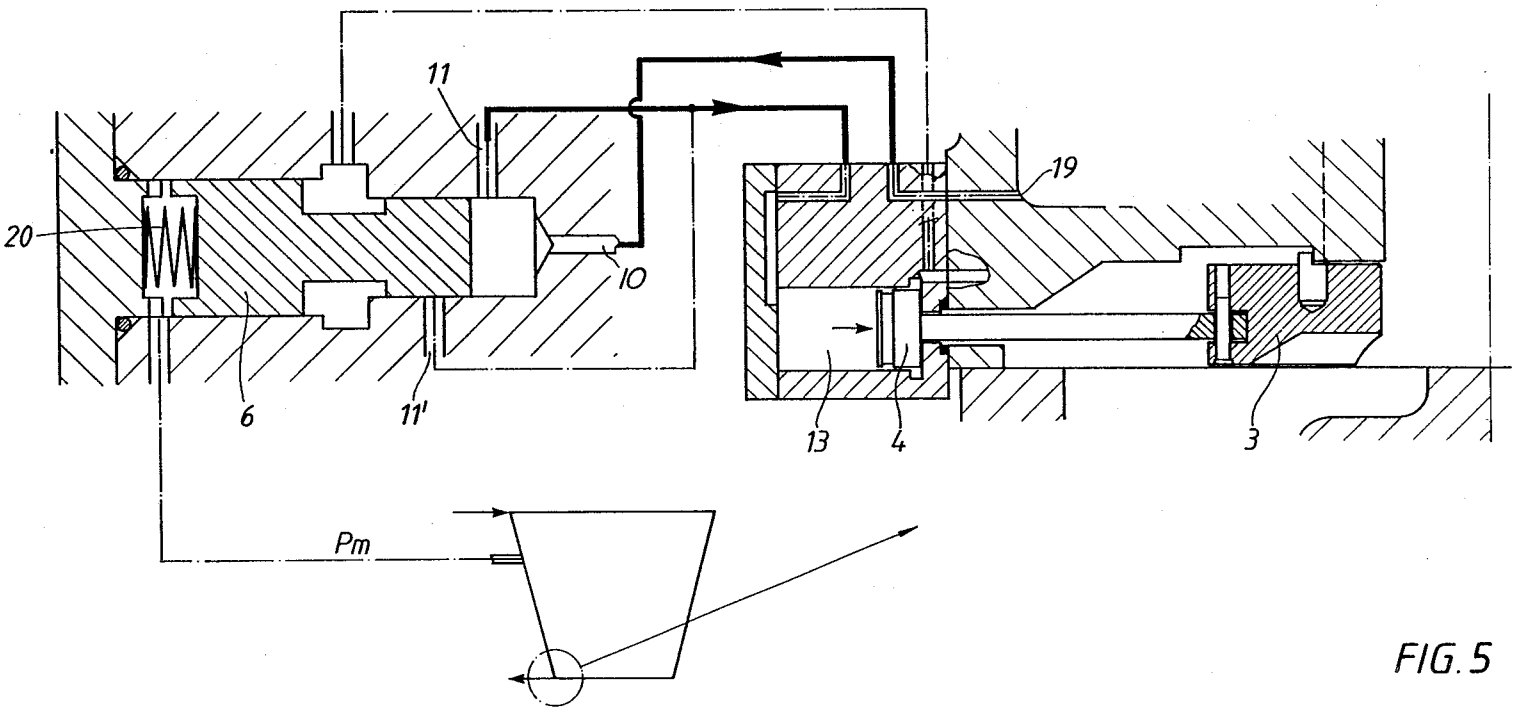
FIG. 5 shows the position of the control section for an operating case with a high pressure ratio (to the left of the dashed line in FIG. 3).

FIGS. 4 and 5 show how the control system functions under different operating conditions. When the pressure P from the system in opening 10 is lower than the intermediate pressure Pm, $P < Pm$, as in FIG. 4, the plunger 6 will assume a position blocking the opening 11 and exposing the opening 11', the opening 11' thus communicating with the low-pressure side through the opening 12. The outlet pressure of the compressor at 18 then forces the valve body 3 with the plunger 4 to an outer position, corresponding to low internal volume. When P1 increases and/or P2 decreases, corresponding to a higher P1/P2, i.e. the pressure on the high-pressure side 19 increases, the plunger 6 will be forced to the left, according to FIG. 5, thus closing the opening 11' and exposing the opening 11. The high pressure from 19 will then be conveyed to the cylinder space 13, thus forcing the plunger 4 to the right. The valve body 3 connected to the plunger 4 will be moved towards a closed position.

Under partial load the intermediate pressure 9 will be lower than under full load, which may correspond to the situation according to FIG. 5. The plunger 6 has then been moved to the left, allowing fluid to flow into the cylinder space 13. The valve body 3 is thus moved to a position corresponding to a high internal volume, which is particularly desirable in order to adjust the internal volume to the partial load condition.

When the compressor is stopped, the pressures will be equalized and the spring 20 then forces the plunger 6 to the right according to FIG. 4. The cylinder 13 in the operating section 2 is then connected to the low-pressure side 17 of the compressor. Upon a subsequent start, the valve body 3 is in a position for low internal volume. This means that the compressor will always start in a position requiring the lowest starting torque.

The control section 1 in the described control system thus controls the operating section 2 to the desired position for full load and partial load, as well as for stopping and starting, without any external control means.

I claim:

1. A control section for a control system for controlling the internal volume in a rotary compressor with an operating section connected to one or more valve bodies, wherein the control section is adapted to be influenced by an intermediate pressure from the compressor against the action of a high pressure from the compressor to position the valve body for control of the internal volume by means of the operating section connected to the control section, and wherein the control section comprises a cylinder having different diameters with a plunger adapted thereto, said plunger having a tapered mid-section separating two plunger end surfaces with different diameters and being connected to a cylinder wall, one of the plunger end surfaces being adapted to close or expose first openings in a wall of the cylinder, and the cylinder is provided with an opening at each end, wherein an intermediate pressure influences the larger end surface of the plunger from the compressor and wherein a high pressure from the compressor influences the smaller end surface of the plunger, and a second opening in a cylinder wall in the area of the mid-section of the plunger is connected to the low-pressure side and the first cylinder wall openings are connected to a cylinder space in the operating section to actuate another plunger connected to the valve body.

2. A control section according to claim 1, wherein the operating section connected to the valve body comprises the other plunger located in (a) the cylinder space and wherein a piston-rod side of the cylinder space is connected to a low-pressure side and the opposite side of the cylinder space is connected to the first openings in the control section.

3. A control section according to claim 1, wherein the larger end of the two surfaces of the plunger is influenced by a spring to move this plunger towards an end position when the compressor is stopped.

4. A control section according to claim 2, wherein the larger end surface of the plunger is influenced by a spring to move this plunger towards an end position when the compressor is stopped.

* * * * *